US012031099B2

(12) United States Patent
Pastorino et al.

(10) Patent No.: US 12,031,099 B2
(45) Date of Patent: Jul. 9, 2024

(54) MARINE FUELS

(71) Applicant: Infineum International Limited, Oxford (GB)

(72) Inventors: Andrea Pastorino, Abingdon (GB); Charlotte Carlisle, Abingdon (GB); Amy J. Challinor, Abingdon (GB)

(73) Assignee: Infineum International Limited, Oxford (GB)

( * ) Notice: Subject to any disclaimer, the term of this patent is extended or adjusted under 35 U.S.C. 154(b) by 0 days.

(21) Appl. No.: 18/052,781

(22) Filed: Nov. 4, 2022

(65) Prior Publication Data

US 2023/0257670 A1 Aug. 17, 2023

(30) Foreign Application Priority Data

Nov. 15, 2021 (EP) ..... 21208157

(51) Int. Cl.
*C10L 9/10* (2006.01)
*C10L 10/18* (2006.01)

(52) U.S. Cl.
CPC ..... *C10L 9/10* (2013.01); *C10L 10/18* (2013.01); *C10L 2200/0213* (2013.01); *C10L 2200/024* (2013.01); *C10L 2200/0245* (2013.01); *C10L 2200/0254* (2013.01); *C10L 2230/04* (2013.01); *C10L 2230/22* (2013.01); *C10L 2250/06* (2013.01)

(58) Field of Classification Search
CPC .... C10L 9/10; C10L 10/18; C10L 2200/0213; C10L 2200/024; C10L 2200/0245; C10L 2200/0254; C10L 2230/04; C10L 2230/22; C10L 2250/06; C10L 2200/0438; C10L 2300/20; C10L 1/1233; C10L 1/1817; C10L 1/1832; C10L 1/189; C10L 1/1966; C10L 1/2437; C10L 2200/0446; C10L 2270/026; C10L 2300/30; C10L 1/106; C10L 1/328; C10L 10/02
See application file for complete search history.

(56) References Cited

U.S. PATENT DOCUMENTS

| | | | |
|---|---|---|---|
| 3,087,936 | A | 4/1963 | Le Suer |
| 3,172,892 | A | 3/1965 | Le Suer et al. |
| 3,215,707 | A | 11/1965 | Rense |
| 3,231,587 | A | 1/1966 | Rense |
| 3,272,746 | A | 9/1966 | Le Suer et al. |

(Continued)

FOREIGN PATENT DOCUMENTS

| | | | |
|---|---|---|---|
| CA | 1335895 | C | 2/1989 |
| EP | 382450 | B1 | 6/1995 |

(Continued)

OTHER PUBLICATIONS

European Search Report Application No. 21208157.4.

*Primary Examiner* — Ellen M Mcavoy
(74) *Attorney, Agent, or Firm* — Robert A. Migliorini

(57) ABSTRACT

An additive composition for a marine fuel or a heating oil comprising a stabilized colloidal dispersion of catalytic metal particles, a neutral or overbased alkaline earth metal detergent and a carrier fluid miscible with a marine fuel oil, a heavy fuel oil, a marine distillate fuel, and/or a residual fuel oil. Also provided are marine fuel and/or heating oil compositions having the additive composition described above and associated methods and uses.

14 Claims, 1 Drawing Sheet

(56) References Cited

U.S. PATENT DOCUMENTS

| | | | | |
|---|---|---|---|---|
| 3,275,554 | A | 9/1966 | Wagenaar | |
| 3,381,022 | A | 4/1968 | Le Suer | |
| 3,442,808 | A | 5/1969 | Traise et al. | |
| 3,565,804 | A | 2/1971 | Honnen et al. | |
| 3,912,764 | A | 10/1975 | Palmer, Jr. | |
| 4,110,349 | A | 8/1978 | Cohen | |
| 4,234,435 | A | 11/1980 | Meinhardt | |
| 5,777,025 | A | 7/1998 | Spencer et al. | |
| 5,891,953 | A | 4/1999 | Spencer et al. | |
| 2003/0182848 | A1* | 10/2003 | Collier | C07C 51/414 44/365 |
| 2004/0011302 | A1* | 1/2004 | May | C10L 10/02 123/1 A |
| 2005/0039382 | A1* | 2/2005 | Blanchard | C10L 10/06 44/362 |
| 2005/0060929 | A1* | 3/2005 | Caprotti | C10L 10/06 44/354 |
| 2009/0000186 | A1* | 1/2009 | Sanders | C10L 10/02 44/321 |
| 2010/0101139 | A1 | 4/2010 | Thompson | |
| 2010/0101211 | A1* | 4/2010 | Thompson | C10L 10/06 60/274 |
| 2013/0337998 | A1* | 12/2013 | Irving | C10L 10/06 502/170 |
| 2014/0007495 | A1* | 1/2014 | D'Alencon | C10L 10/06 44/321 |
| 2014/0033604 | A1* | 2/2014 | D'Alencon | B01J 13/0034 44/354 |
| 2015/0210947 | A1* | 7/2015 | Parson | C10L 10/12 44/361 |
| 2015/0232775 | A1 | 8/2015 | Harle et al. | |
| 2020/0199472 | A1* | 6/2020 | Kerby | C10L 1/18 |

FOREIGN PATENT DOCUMENTS

| | | | |
|---|---|---|---|
| EP | 1496100 | A1 | 12/2005 |
| EP | 1905813 | A2 | 2/2008 |
| EP | 1905813 | A3 | 5/2008 |
| GB | 1440219 | A1 | 6/1976 |
| GB | 2248068 | A1 | 3/1992 |
| WO | 2008-084251 | A1 | 7/2008 |

* cited by examiner

MARINE FUELS

PRIORITY CLAIM

This invention claims priority from European Patent Application EP 21208157.4, filed in the European Patent Office on Nov. 15, 2021, the entire contents of which are hereby incorporated by reference.

FIELD OF THE INVENTION

This invention relates to additives for marine fuels to improve the fuel economy, combustion characteristics and/or emissions performance of the marine fuel, in particular to additives comprising the combination of an overbased alkaline earth metal detergent (wherein the alkaline earth metal is selected from calcium and/or strontium) and a colloidally dispersed and stabilized compound of iron and/or cerium.

BACKGROUND OF THE INVENTION

Marine fuel constitutes some of the more viscous and dense fuels available for combustion, and have typically contained high levels of sulfur, asphaltenic material and other contaminants, such as metals and cat-fines, as a result of the refining processes. Accordingly, they may be considered to be low grade fuels that are undesirable for use in many modes of transport. However, the maritime shipping and other industries can make good use of these fuels due to the size and robustness of typical marine engines. While the size of marine engines thus provides this advantage, the combustion of such fuels in large volumes commensurate with larger engine size also leads to higher volumes of emissions, including particulates that may impact coastal air quality, and fuel can represent 50-60% of the total operating costs of a vessel. Similar considerations also apply to heating oils.

The IMO (International Maritime Organization) implemented the 2020 sulfur cap in order to lower the sulfur level in marine fuels to a 0.5% limit in order to address some of the emissions from marine engines. It is anticipated that further legislation specifically for marine engines may follow to focus on the reduction of NOx and greenhouse gas (GHG) emissions. For example, the IMO have set an ambitious target of 70% reduction of GHG emissions from the marine industry by 2050 (compared to 2008 levels) and may seek to address challenges concerning particulate emissions and coastal air quality in the future. Engineering alternatives being adopted for automotive transportation and utilizing batteries and renewable fuels to address NOx and GHG emission concerns are practically more challenging to adopt for marine transportation, due to the size of marine engines, relatively slow turnover of engine technology in the marine industry (vessels having a typical lifespan of some thirty years or more) and the infrastructure that supports shipping, notably in relation to bunkering. Even while diesel and petrol are joined by batteries and other renewable fuels in the automotive sector, it is likely that the marine industry will continue to require large volumes of fossil-based fuel for the foreseeable future.

Therefore it is an important endeavour, if the marine industry is to meet GHG/emissions targets set by the IMO, to pursue technology to reduce fuel consumption and emissions from current marine fuel, or alternatively stated, to facilitate more efficient vessel operations that produce lower outputs of GHG/NOx/sulfur emissions.

Marine fuel additives such as catalytic metals have been used to affect fuel combustion in efforts to improve performance. For example: WO 2008/084251A1 describes a metal compound such as ferrocene in combination with an organic compound and stabilizer to achieve improved fuel economy by permitting heavier and/or dirtier fuels to be used in place of lighter and/or cleaner fuels. US 2015/0210947A1 describes a molecular sized iron compound such as ferrocene in combination with an overbased magnesium compound, the molecular size achieved, for example, by dissolving compounds in xylene. This is indicated to reduce consumption of diesel fuel in automotive trucks and to simultaneously reduce pollutants from the exhaust gas resulting from fuel combustion using a catalytic fuel additive, which has such low particle density and particle size that damage to equipment using the additive is virtually eliminated and any metallic ash released into the atmosphere is considerably below the then current Environmental Protection Agency recommended standards. GB 2248068A describes soluble metal fuel oil additives for the inhibition of smoke and/or particulate emissions on combustion of the oil.

However, there remains a need for marine fuel additive compositions that can offer improvements to the fuel economy, combustion characteristics, and/or emissions performance of the marine fuel, particularly without changing the base fuel being used.

SUMMARY OF THE INVENTION

Figure 1:
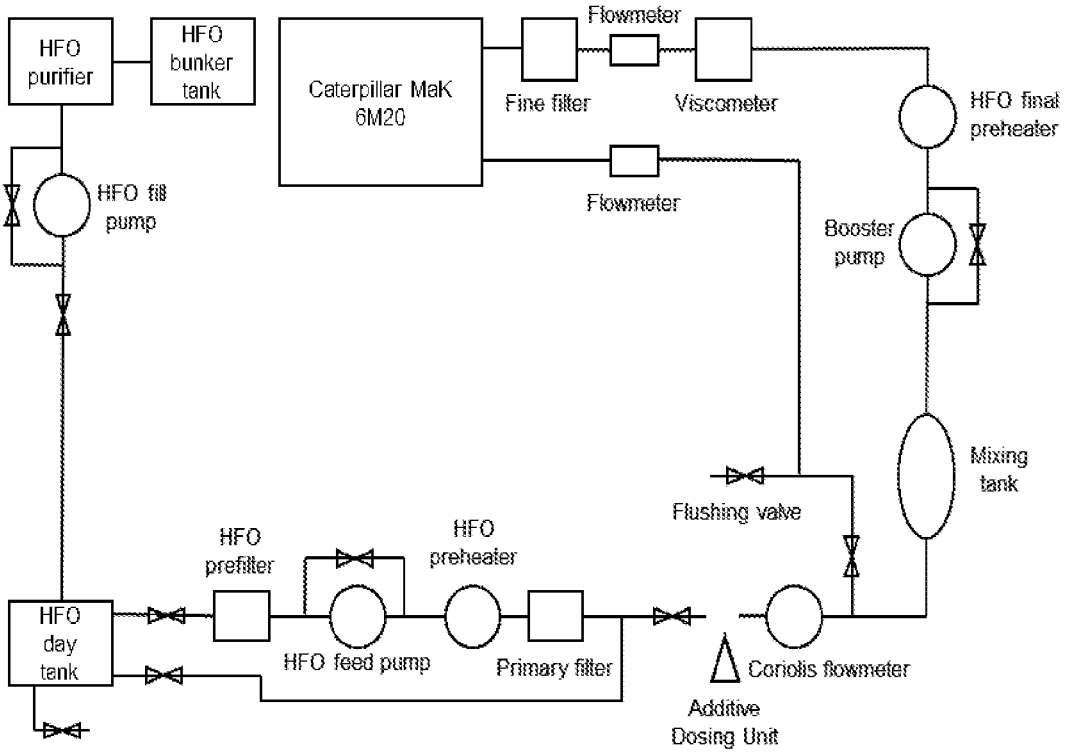
FIG. 1 shows a schematic of a fuel system for dosing the additive(s) into fuel of a Caterpillar MaK 6M20, 6 cylinder, 4 stroke test engine with pump line nozzle injection.

Surprisingly, it has now been found that the combination of stabilized, colloidally dispersed particles of a catalytic metal compoound, particularly iron and/or cerium oxides/compounds, with an alkaline earth metal detergent comprising calcium and/or strontium synergistically improves the fuel economy, emissions performance and combustion characteristics of marine fuels and heating oils.

Accordingly, in a first aspect, the invention comprises an additive composition for a marine fuel or a heating oil comprising: (A) a colloidal dispersion of catalytic metal particles, the particles comprising: (i) a metal compound core, the metal compound comprising at least one of iron, ruthenium, osmium, cerium, nickel, palladium and platinum; and (ii) a polyalkenyl-substituted carboxylic acid or anhydride, or a derivative thereof; (B) a neutral or overbased alkaline earth metal detergent comprising calcium and/or strontium; and (C) a carrier fluid miscible with a marine fuel oil, a heavy fuel oil, a marine distillate fuel, and/or a residual fuel oil.

In a second aspect, the invention comprises a marine fuel composition or heating oil composition comprising an additive composition according to the first aspect of the invention and a marine fuel oil, a heavy fuel oil, a marine distillate fuel and/or a residual fuel oil.

In a third aspect, the invention comprises a method of improving the fuel economy, combustion characteristics and/or emissions performance of a marine fuel or heating oil comprising the step of combining the marine fuel or heating oil with an additive composition according to the first aspect of the invention.

In a fourth aspect, the invention comprises a method of producing a marine fuel composition or heating oil composition comprising the step of combining a marine fuel oil, a heavy fuel oil, a marine distillate fuel and/or a residual fuel oil with an additive composition according to the first aspect of the invention.

In a fifth aspect, the invention comprises a use of an additive composition according to the first aspect of the invention to improve the fuel economy, combustion characteristics and/or emissions performance of a marine fuel or heating oil.

In a sixth aspect, the inventions provides the use of a two-way additive combination, in an effective minor amount, in a marine fuel or heating oil to improve the fuel economy, combustion characteristics and/or emissions perfomance of said marine fuel or said heating oil, the two-way additive combination comprising (A) a colloidal dispersion of catalytic metal particles, the particles comprising: (i) a metal compound core, the metal compound comprising at least one of iron, ruthenium, osmium, cerium, nickel, palladium, and platinum, as deined and identifed herein; and (ii) a polyalkenyl-substituted carboxylic acid or anhydride, or a derivative thereof, as defined and identified herein; and, (B) a neutral or overbased alkaline earth metal detergent comprising calcium and/or strontium, as defined and identified herein.

In some embodiments, such as the second to fifth aspects of the invention, the marine fuel, heating oil, heavy fuel oil, marine distillate fuel, and/or a residual fuel oil, respectively, is present in a major amount (such as greater than 50 mass %), based on the total mass of the composition.

In some embodiments, such as the second to fifth aspects of the invention, the additive composition, is present in a minor amount (such as less than 50 mass %), based on the total mass of the composition.

In some embodiments, the additive composition of the first aspect and two-way additive combination of the sixth aspect comprises (A) a colloidal dispersion of catalytic metal particles, the metal particles comprising: (i) a metal compound core, the metal compound comprising at least one of iron and cerium, preferably iron, (ii) a polyalkenyl-substituted carboxylic acid or anhydride, or a derivative thereof, as defined and identified herein; and, (B) a neutral or overbased alkaline earth metal detergent, as defined and identified herein.

In some embodiments, the additive composition of the first aspect and two-way additive combination of the sixth aspect comprises (A) a colloidal dispersion of catalytic metal particles, the metal particles comprising: (i) a metal compound core, the metal compound comprising at least one of iron and cerium, preferably iron, (ii) a polyalkenyl-substituted carboxylic acid or anhydride, or a derivative thereof, as defined and identified herein; and, (B) a neutral or overbased calcium detergent, as defined and identified herein.

In some embodiments, the additive composition and two-way additive combination, each as defined and identified herein, comprises (A) a colloidal dispersion of catalytic metal particles, the metal particles comprising: (i) a metal compound core, the metal compound comprising at least one of iron and cerium, preferably iron, (ii) a polyisobutenyl-substituted succinic anhydride or succinic acid, or a derivative thereof, as defined and identified herein; and, (B) an overbased calcium detergent, as defined and identified herein.

In some embodiments, (c) the neutral or overbased alkaline earth metal detergent comprising calcium and/or strontium, of the additive composition, comprises an overbased alkaline earth metal detergent, such as an overbased calcium detergent, as defined and identified herein.

In some embodiments, (c) the neutral or overbased alkaline earth metal detergent comprising calcium and/or strontium, of the additive composition, comprises an overbased calcium salicylate detergent.

In some embodiments, the invention is directed to a marine fuel oil, a heavy fuel oil, a marine distillate fuel and/or a residual fuel oil, particularly a marine fuel or marine distillate fuel.

In some embodiments, the additive composition and two-way additive combination, each as defined and identified herein, comprises (A) a colloidal dispersion of catalytic metal particles, the metal particles comprising (i) an iron compound core.

In some embodiments, the invention is directed to improving the combustion characteristics of a marine fuel or marine distillate fuel.

In some embodiments, the invention is directed to reducing emissions from a marine fuel or marine distillate fuel.

DETAILED DESCRIPTION OF THE INVENTION

Definitions

The following definitions are provided for purpose of illustration and not limitation.

"Alkyl" refers to a monovalent hydrocarbon group containing no double or triple bonds and arranged in a branched or straight chain.

"Alkylene" refers to a divalent hydrocarbon group containing no double or triple bonds and arranged in a branched or straight chain.

"Alkenyl" refers to a monovalent hydrocarbon group containing one or more double bonds and arranged in a branched or straight chain.

"PIB" refers to polyisobutylene and includes both normal or "conventional" polyisobutylene and highly reactive polyisobutylene (HRPIB).

Reference to a group being a particular polymer [e.g., polypropylene, poly(ethylene-co-propylene) or PIB] encompasses polymers that contain primarily the respective monomer along with negligible amounts of other substitutions and/or interruptions along a polymer chain. In other words, reference to a group being a polypropylene group does not require that the group consist of 100% propylene monomers without any linking groups, substitutions, impurities, or other substituents (e.g., alkylene or alkenylene substituents). Such impurities or other substituents may be present in relatively minor amounts provided they do not affect the industrial performance of the additive, compared with the same additive containing the respective polymer substituent at 100% purity.

"Hydrocarbyl" means a group or radical that contains carbon and hydrogen atoms and that is bonded to the remainder of the molecule via a carbon atom. It may contain hetero atoms, i.e., atoms other than carbon and hydrogen, provided they do not alter the essentially hydrocarbon nature and characteristics of the group.

Also, the following words and expressions, if and when used, have the meanings ascribed below:

"active ingredients" or "(a.i.)" refers to additive material that is not diluent or solvent. Unless stated otherwise, all mass % values stated herein refer to mass % on an active ingredient basis of the respective component;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means 50 mass % or more, preferably 60 mass % or more, more preferably 70 mass % or more, even more preferably 80 mass % or more, of a composition;

"minor amount" means less than 50 mass %, preferably less than 40 mass %, more preferably less than 30 mass %, and even more preferably less than 20 mass %, of a composition;

"effective minor amount" means in a minor amount which is sufficient to produce the desired technical effect;

"ppm" means parts per million by mass %, on an active ingredient basis;

"molecular weight", unless otherwise specified, is in g/mol or Daltons;

"TBN" means total base number as measured by ASTM D2896.

Furthermore in this specification, if and when used:

"calcium content" is as measured by ASTM D4951;

"phosphorus content" is as measured by ASTM D5185;

"sulphated ash content" is as measured by ASTM D874;

"sulfur content" is as measured by ASTM D2622;

"KV100" means kinematic viscosity at 100° C. as measured by ASTM D445.

"particle size" means the particle diameter for which 80% of the particles have a diameter of less than the indicated value (180), as determined, for example, by transmission electron microscopy. In addition to other techniques known to the skilled person, transmission electron microscopy may be used by diluting samples to a concentration of 0.035% by weight using xylene and filtered through carbon support grids. Typically, approximately 80 to 90% of particles may be identified and measured correctly from 2 to 5 transmission electron microscopy images.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined and include "about" the quantity, range, or ratio limit in question.

Stabilized Catalytic Metal Particles (A)

Aspects according to the present invention comprise a colloidal dispersion of catalytic metal particles and a polyalkenyl-substituted carboxylic acid or anhydride stabilizer. Within the colloidal dispersion, the catalytic metal particles typically have a particle size of at least 1 nm, such as in a range with a lower end independently selected from 1 nm, 1.25 nm, 1.5 nm, 1.75 nm, 2 nm, 2.25 nm, 2.5 nm, 2.75 nm, 3 nm, 3.25 nm, 3.5 nm, 3.6 nm, 3.7 nm, 3.75 nm, 3.8 nm, 3.9m, 4 nm, 4.1 nm, 4.2 nm, 4.25 nm, 4.3 nm, 4.4 nm, 4.5 nm, 4.6 nm, 4.7 nm, 4.75 nm, 4.8 nm, 4.85 nm, 4.9 nm, 4.95 nm or 5 nm and with an upper end independently selected from 1 μm, 950 nm, 900 nm, 850 nm, 800 nm, 750 nm, 700 nm, 650 nm, 600 nm, 550 nm, 500 nm, 450 nm, 400 nm, 350 nm, 300 nm, 250 nm, 200 nm, 175 nm, 150 nm, 125 nm, 100 nm, 90 nm, 80 nm, 70 nm, 60 nm, 50 nm, 45 nm, 40 nm, 35 nm, 30 nm, 28 nm, 25 nm, 22 nm, 20 nm, 19 nm, 18 nm, 17 nm, 16 nm or 15 nm. The particle size may be from 1 nm to 1 μm, from 2 nm to 500 nm, from 3 nm to 100 nm, from 3 nm to 50 nm or from 5 nm to 15 nm.

Catalytic Metal Compound

The catalytic metal particles in the present invention comprise a metal compound selected from iron, ruthenium, osmium, cerium, nickel, palladium, platinum and mixtures thereof. The catalytic metal particles form a colloidal dispersion in the additive composition and/or marine fuel or marine fuel oil. That is to say, the metal compound is not present primarily or exclusively in solution as in the case of ferrocene. The catalytic metal particles may comprise (or alternatively stated, the metal compound may be) one or more compounds of iron, compounds of cerium, and mixtures thereof. While the anion in the compound is not generally limited, the catalytic metal particles may comprise (or alternatively stated, the metal compound may be) an oxide. The catalytic metal particles may comprise (or alternatively stated, the metal compound may be) one or more iron oxide, cerium oxide, and mixtures thereof. The catalytic metal particles may comprise (or alternatively stated, the metal compound may be) an iron oxide such as iron (II) oxide, iron (III) oxide and/or iron (II,III) oxide. The catalytic metal particles may comprise (or alternatively stated, the metal compound may be) iron (III) oxide and/or iron (II,III) oxide.

Polyalkenyl-Substituted Carboxylic Acid or Anhydride Stabilizer

Additive component (A) comprises a polyalkenyl-substituted carboxylic acid or anhydride stabilizer, or a derivative thereof. The stabilizer may be colloidally dispersible or soluble in a marine fuel and/or marine fuel oil as described herein.

In an alternative description, the stabilizer may be an organic compound, said organic compound having a hydrocarbyl chain and at least one (preferably two or more) carboxylic acid or carboxylate functional group at an end of the hydrocarbyl chain. Where two or more carboxylic acid or carboxylate functional groups are present, the groups are preferably separated from one another by no more than three or by no more than two carbon atoms within the oil soluble or oil dispersible organic compound.

The polyalkenyl-substituted carboxylic acid or anhydride stabilizer may be mono- or polycarboxylic, is preferably mono-, di-, or tri-carboxylic and is more preferably dicarboxylic. In some embodiments, therefore, the polyalkenyl-substituted carboxylic acid or anhydride stabilizer has a plurality of carboxylic acid or carboxylate moieties. In some non-limiting examples of the aforementioned derivatives, any or all of the carboxylic acid moieties present may be ionized in the form $—(COO—)_nM^{n+}$ where M is an n-positively charged metal cation (such as a uni-, di-, or tri-positively charged metal cation (i.e., where n=1, 2 or 3)) or a quaternary ammonium cation. In instances where the polyalkenyl- sub stituted carboxylic acid or anhydride stabilizer is di-, tri-, or polycarboxylic, the carboxylic acid or carboxylate groups are preferably separated from one another by no more than three or by no more than two carbon atoms within the polyalkenyl-substituted carboxylic acid or anhydride stabilizer. That is to say that each carboxylic acid or carboxylate moiety has at least one other carboxylic acid or carboxylate moiety separated from it by no more than three or by no more than two carbon atoms within the polyalkenyl-substituted carboxylic acid or anhydride stabilizer. Accordingly, the carboxylic acid or carboxylate moieties may effectively form pairs or groups within the molecule, each pair or group may be preferably separated from one another by no more than three or by no more than two carbon atoms within the polyalkenyl-substituted carboxylic acid or anhydride stabilizer, or alternatively by more carbon atoms, such as 4, 5, 6, 7, 8, 9, 10, or more than 10 carbon atoms. An anhydride automatically satisfies this definition, however, more than one anhydride moiety may be present, and the anhydride groups may be preferably separated from one another by no more than three or by no more than two carbon atoms within the polyalkenyl-substituted carboxylic acid or anhydride stabilizer, or alternatively by more carbon atoms, such as 4, 5, 6, 7, 8, 9, 10, or more than 10 carbon atoms.

In some preferred embodiments, where a plurality of carboxylic acid or carboxylate moieties are present within the polyalkenyl-substituted carboxylic acid or anhydride stabilizer, all of the carboxylic acid or carboxylate moieties are contiguous. By contiguous, it is meant that the separation of adjacent carboxylic acid or carboxylate moieties from one another is by no more than three or by no more than two carbon atoms within the polyalkenyl-substituted carboxylic acid or anhydride stabilizer. Accordingly, it may be described that a continuous chain of separation by no more than two carbon atoms within the polyalkenyl-substituted carboxylic acid or anhydride stabilizer connects all of the carboxylic acid or carboxylate moieties within the polyalkenyl-substituted carboxylic acid or anhydride stabilizer.

Exemplary anhydrides may be depicted by the general formulae:

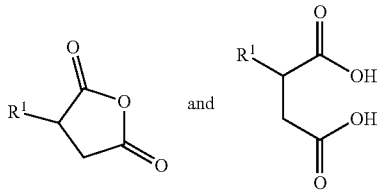

where $R^1$ represents a $C_8$ to $C_{100}$ branched or linear polyalkenyl group.

In some embodiments, the polyalkenyl group has from 8 to 400, such as 12 to 100, carbon atoms. The polyalkenyl moiety may have a number average molecular weight of from 200 to 10000, preferably from 350 to 2000, preferably 500 to 1000. Some examples of the number average molecular weight of the polyalkenyl moiety include from 100 to 4000, from 200 to 2250, from 250 to 2000, from 500 to 1500, from 750 to 1250 or from 850 to 1100.

Suitable hydrocarbons or polymers employed in the formation of the anhydrides used in the present invention to generate the polyalkenyl moieties include homopolymers, interpolymers or lower molecular weight hydrocarbons. One family of such polymers comprise polymers of ethylene and/or at least one $C_3$ to $C_{28}$ alpha-olefin having the formula $H_2C{=}CHR^1$ wherein $R^1$ is straight or branched-chain alkyl radical comprising 1 to 26 carbon atoms and wherein the polymer contains carbon-to-carbon unsaturation, preferably a high degree of terminal ethenylidene unsaturation. Preferably, such polymers comprise interpolymers of ethylene and at least one alpha-olefin of the above formula, wherein $R^1$ is alkyl of from 1 to 18, more preferably from 1 to 8, and more preferably still from 1 to 2, carbon atoms. Therefore, useful alpha-olefin monomers and comonomers include, for example, propylene, butene-1, hexene-1, octene-1, 4-methylpentene-1, decene-1, dodecene-1, tridecene-1, tetradecene-1, pentadecene-1, hexadecene-1, heptadecene-1, octadecene-1, nonadecene-1, and mixtures thereof (e.g., mixtures of propylene and butene-1). Exemplary of such polymers are propylene homopolymers, butene-1 homopolymers, ethylene-propylene copolymers, ethylene-butene-1 copolymers, and propylene-butene copolymers, wherein the polymer contains at least some terminal and/or internal unsaturation. Preferred polymers are unsaturated copolymers of ethylene and propylene and ethylene and butene-1. The interpolymers may contain a minor amount, e.g., 0.5 to 5 mol %, of a $C_4$ to $C_{18}$ non-conjugated di-olefin comonomer. However, it is preferred that the polymers comprise only alpha-olefin homopolymers, interpolymers of alpha-olefin comonomers and interpolymers of ethylene and alpha-olefin comonomers. The molar ethylene content of the polymers employed is preferably in the range of 0% to 80%, more preferably 0% to 60%. When propylene and/or butene-1 are employed as comonomer(s) with ethylene, the ethylene content of such copolymers is most preferably between 15 and 50%, although higher or lower ethylene contents may be present.

These polymers may be prepared by polymerizing an alpha-olefin monomer, or mixtures of alpha-olefin monomers, or mixtures comprising ethylene and at least one $C_3$ to $C_{28}$ alpha-olefin monomer, in the presence of a catalyst system comprising at least one metallocene (e.g., a cyclopentadienyl-transition metal compound) and an alumoxane compound. Using this process, a polymer in which 95% or more of the polymer chains possess terminal ethenylidene-type unsaturation can be provided. The percentage of polymer chains exhibiting terminal ethenylidene unsaturation may be determined by FTIR spectroscopic analysis, titration, or $^{13}C$ NMR. Interpolymers of this latter type may be characterized by the formula $POLY{-}C(R^1){=}CH_2$ wherein $R^1$ is $C_1$ to $C_{26}$, preferably $C_1$ to $C_{18}$, more preferably $C_1$ to $C_8$, and most preferably Ci to $C_2$, alkyl, (e.g., methyl or ethyl) and wherein POLY represents the polymer chain. The chain length of the $R^1$ alkyl group will vary depending on the comonomer(s) selected for use in the polymerization. A minor amount of the polymer chains can contain terminal ethenyl, i.e., vinyl, unsaturation, i.e., $POLY{-}CH{=}CH_2$, and a portion of the polymers can contain internal monounsaturation, e.g., $POLY{-}CH{=}CH(R^1){-}POLY$, wherein $R^1$ is as defined above. These terminally unsaturated interpolymers may be prepared by known metallocene chemistry and may also be prepared as described in U.S. Pat. Nos. 5,498,809; 5,663,130; 5,705,577; 5,814,715; 6,022,929; and 6,030,930.

Another useful class of polymers is that of polymers prepared by cationic polymerization of isobutene and styrene. Common polymers from this class include polyisobutenes obtained by polymerization of a $C_4$ refinery stream having a butene content of 35 to 75 mass %, and an isobutene content of 30 to 60 mass %, in the presence of a Lewis acid catalyst, such as aluminum trichloride or boron trifluoride. A preferred source of monomer for making poly-n-butenes is petroleum feedstreams such as Raffinate II. These feedstocks are disclosed in the art such as in U.S. Pat. No. 4,952,739. Polyisobutylene is a most preferred backbone because it is readily available by cationic polymerization from butene streams (e.g., using $AlCl_3$ or $BF_3$ catalysts). Such polyisobutylenes generally contain residual unsaturation in amounts of one ethylenic double bond per polymer chain, positioned along the chain. A preferred embodiment utilizes polyisobutylene prepared from a pure isobutylene stream or a Raffinate I stream to prepare reactive isobutylene polymers with terminal vinylidene olefins. Preferably, these polymers, referred to as highly reactive polyisobutylene (HR-PIB), have a terminal vinylidene content of at least 65%, e.g., 70%, more preferably at least 80%, even more preferably at least 85%. The preparation of such polymers is described, for example, in U.S. Pat. No. 4,152,499. HR-PIB is known and HR-PIB is commercially available under the tradenames Glissopal™ (from BASF) and Ultravis™ (from BP-Amoco).

Polyisobutylene polymers that may be employed are generally based on a hydrocarbon chain of from 400 to 3000. Methods for making polyisobutylene are known. Polyisobutylene can be functionalized by halogenation (e.g., chlorination), the thermal "ene" reaction, or by free radical grafting using a catalyst (e.g., peroxide), as described below.

The hydrocarbon or polymer backbone may be functionalized with carboxylic anhydride-producing moieties selectively at sites of carbon-to-carbon unsaturation on the polymer or hydrocarbon chains, or randomly along chains using any of the three processes mentioned above or combinations thereof, in any sequence.

Processes for reacting polymeric hydrocarbons with unsaturated carboxylic, anhydrides and the preparation of derivatives from such compounds are disclosed in U.S. Pat. Nos. 3,087,936; 3,172,892; 3,215,707; 3,231,587; 3,272,746; 3,275,554; 3,381,022; 3,442,808; 3,565,804; 3,912,764; 4,110,349; 4,234,435; 5,777,025; 5,891,953; as well as EP 0 382 450 B1; CA-1,335,895; and GB-A-1,440,219. The polymer or hydrocarbon may be functionalized, with carboxylic acid anhydride moieties by reacting the polymer or hydrocarbon under conditions that result in the addition of functional moieties or agents, i.e., acid anhydride, onto the polymer or hydrocarbon chains primarily at sites of carbon-to-carbon unsaturation (also referred to as ethylenic or olefinic unsaturation) using the halogen assisted functionalization (e.g., chlorination) process or the thermal "ene" reaction.

Selective functionalization can be accomplished by halogenating, e.g., chlorinating or brominating, the unsaturated a-olefin polymer to 1 to 8, preferably 3 to 7, mass % chlorine, or bromine, based on the weight of polymer or hydrocarbon, by passing the chlorine or bromine through the polymer at a temperature of 60° C. to 250° C., preferably 110° C. to 160° C., e.g., 120° C. to 140° C., for 0.5 to 10 hours, preferably 1 to 7 hours. The halogenated polymer or hydrocarbon (hereinafter backbone) is then reacted with sufficient monounsaturated reactant capable of adding the required number of functional moieties to the backbone, e.g., monounsaturated carboxylic reactant, at 100° C. to 250° C., usually 180° C. to 235° C., for 0.5 to 10 hours, e.g., 3 to 8 hours, such that the product obtained will contain the desired number of moles of the monounsaturated carboxylic reactant per mole of the halogenated backbones. Alternatively, the backbone and the monounsaturated carboxylic reactant are mixed and heated while adding chlorine to the hot material.

While chlorination normally helps increase the reactivity of starting olefin polymers with monounsaturated functionalizing reactant, it is not necessary with some of the polymers or hydrocarbons contemplated for use in the present invention, particularly those preferred polymers or hydrocarbons which possess a high terminal bond content and reactivity. Preferably, therefore, the backbone and the monounsaturated functionality reactant, (carboxylic reactant), are contacted at an elevated temperature to cause an initial thermal "ene" reaction to take place. Ene reactions are known.

The hydrocarbon or polymer backbone can be functionalized by random attachment of functional moieties along the polymer chains by a variety of methods. For example, the polymer, in solution or in solid form, may be grafted with the monounsaturated carboxylic reactant, as described above, in the presence of a free-radical initiator. When performed in solution, the grafting takes place at an elevated temperature in the range of 100° C. to 260° C., preferably 120° C. to 240° C. Preferably, free-radical initiated grafting would be accomplished in a mineral lubricating oil solution containing, e.g., 1 to 50, preferably 5 to 30, mass % polymer based on the initial total oil solution.

The free-radical initiators that may be used are peroxides, hydroperoxides, and azo compounds, preferably those that have a boiling point greater than 100° C. and decompose thermally within the grafting temperature range to provide free-radicals. Representative of these free-radical initiators are azobutyronitrile, 2,5 -dimethylhex-3-ene-2, 5-bis-tertiary-butyl peroxide and dicumene peroxide. The initiator, when used, is typically in an amount of between 0.005 and 1% by weight based on the weight of the reaction mixture solution. Typically, the aforesaid monounsaturated carboxylic reactant material and free-radical initiator are used in a weight ratio range of from 1.0:1 to 30:1, preferably 3:1 to 6:1. The grafting is preferably carried out in an inert atmosphere, such as under nitrogen blanketing. The resulting grafted polymer is characterized by having carboxylic acid (or derivative) moieties randomly attached along the polymer chains, it being understood that some of the polymer chains remain ungrafted. The free radical grafting described above can be used for the other polymers and hydrocarbons used in the present invention.

The preferred monounsaturated reactants that are used to functionalize the backbone comprise mono- and di-carboxylic acid material, i.e., acid, or acid derivative material, including (i) monounsaturated $C_4$ to $C_{10}$ di-carboxylic acid wherein (a) the carboxyl groups are vicinal, (i.e., located on adjacent carbon atoms) and (b) at least one, preferably both, of the adjacent carbon atoms are part of the monounsaturation; (ii) derivatives of (i) such as anhydrides or $C_1$ to $C_5$ alcohol derived mono- or diesters of (i); (iii) monounsaturated $C_3$ to $C_{10}$ monocarboxylic acid wherein the carbon-carbon double bond is conjugated with the carboxy group, i.e., of the structure —C═C—CO—; and (iv) derivatives of (iii) such as $C_1$ to $C_5$ alcohol derived mono- or diesters of (iii). Mixtures of monounsaturated carboxylic materials (i)-(iv) also may be used. Upon reaction with the backbone, the monounsaturation of the monounsaturated carboxylic reactant becomes saturated. Thus, for example, maleic anhydride becomes backbone-substituted succinic anhydride, and acrylic acid becomes backbone-substituted propionic acid. Exemplary of such monounsaturated carboxylic reactants are fumaric acid, itaconic acid, maleic acid, maleic anhydride, chloromaleic acid, chloromaleic anhydride, acrylic acid, methacrylic acid, crotonic acid, cinnamic acid, and lower alkyl (e.g., $C_1$ to $C_4$ alkyl) acid esters of the foregoing, e.g., methyl maleate, ethyl fumarate, and methyl fumarate.

To provide the required functionality, the monounsaturated carboxylic reactant, preferably maleic anhydride, typically will be used in an amount ranging from equimolar amount to 100, preferably 5 to 50, mass % excess, based on the moles of polymer or hydrocarbon. Unreacted excess monounsaturated carboxylic reactant can be removed from the final dispersant product by, for example, stripping, usually under vacuum, if required.

Accordingly, particular stabilizers include poly (isobutene) succinic anhydride (PIB-succinic anhydride) and poly(isobutene) succinic acid (PIB-succinic acid), more particularly poly(isobutene) succinic acid (PIB-succinic acid). When present, the poly(isobutene) succinic anhydride and poly(isobutene) succinic acid may have any of the features of the stabilizer mentioned above, specifically including without limitation a polyisobutenyl moiety having from 8 to 400, such as 12 to 100, carbon atoms and/or polyisobutenyl moiety having a number average molecular weight of from 200 to 10000, preferably from 350 to 2000, preferably 500 to 1000. Some examples of the number average molecular weight of the polyisobutenyl moiety include from 100 to 4000, from 200 to 2250, from 250 to 2000, from 500 to 1500, from 750 to 1250 or from 850 to 1100. As may be seen in the exemplary formula below, PIB-succinic acid may be bismaleated, in which more than one, succinic acid or anhydride derived moiety is present (notably, two are present) in the polyalkenyl-substituted carboxylic acid or anhydride stabilizer and the more than one succinic acid or anhydride derived moieties may be separated from one another by no more than three or by no more than two carbon atoms within the polyalkenyl-substituted carboxylic acid or anhydride stabilizer, or alternatively by more carbon atoms, such as 4, 5, 6, 7, 8, 9, 10, or more than 10 carbon atoms. They may accordingly be only one polyalkenyl-substitution, as also depicted in the exemplary formula below.

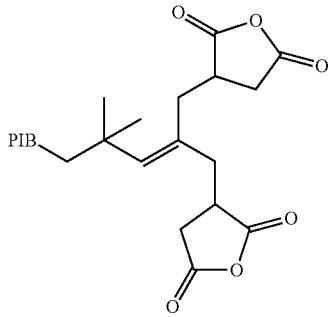

Poly(isobutene) succinic anhydride (PIB-succinic anhydride) and poly(isobutene) succinic acid (PIB-succinic acid) may particularly be used in combination with catalytic metal particles comprising (or alternatively stated, the metal compound may be) iron oxide, cerium oxide, and mixtures thereof, such as catalytic metal particles comprising (or alternatively stated, the metal compound may be) an iron oxide such as iron (II) oxide, iron (III) oxide and/or iron (II,III) oxide or such as catalytic metal particles comprising (or alternatively stated, the metal compound may be) iron (III) oxide and/or iron (II,III) oxide.

The stabilizer may also be a fatty acid, of which examples include capric acid, lauric acid, myristic acid, palmitic acid, stearic acid, arachidic acid, behenic acid, lignoceric acid, caproleic acid, lauroleic acid, myristoleic acid, palmitoleic acid, oleic acid, elaidic acid, vaccenic acid, gadoleic acid, erucic acid, brassidic acid, nervonic acid, linoleic acid, dienoic acid, α-linolenic acid, α-linolenic acid, columbinic acid, stearidonic acid, mead acid, dihomo-γ-linolenic acid, arachidonic acid, eicosapentaenoic acid, docosapentaenoic acid, docosahexaenoic acid, and mixtures thereof. In some embodiments, the fatty acid or mixture thereof may comprise one or more polyunsaturated (two or more C═C double bonds), monounsaturated or saturated fatty acids and may notably comprise monounsaturated or saturated acids such as capric acid, lauric acid, myristic acid, palmitic acid, stearic acid, arachidic acid, behenic acid, lignoceric acid, caproleic acid, lauroleic acid, myristoleic acid, palmitoleic acid, oleic acid, elaidic acid, vaccenic acid, gadoleic acid, erucic acid, brassidic acid, nervonic acid and mixtures and derivatives thereof, in addition to corresponding di-, tri-, and poly-acids which would be mono-, di-, or tri-carboxylic and accordingly may have any of the corresponding features described above. The fatty acid may have at least 10, at least 12, at least 14, or at least 16 carbon atoms and at most 30, at most 28, at most 26 or at most 24 carbon atoms. Exemplary ranges for the number of carbon atoms in the fatty acid include those with a lower limit selected from 10, 12, 14, 16, 18, 20, 22, 24, 26, 28, or 30 carbon atoms and an upper limit selected from 10, 12, 14, 16, 18, 20, 22, 24, 26, 28, or 30 carbon atoms, such as from 10 to 30 carbon atoms, from 12 to 28 carbon atoms, from 14 to 26 carbon atoms, or from 16 to 24 carbon atoms. The stabilizer may be a fatty acid natural product, such as one commercially available, that would be expected to comprise a mixture of a plurality, typically several, of the fatty acids listed above.

Alkaline Earth Metal Detergent (B)

A metal detergent is an additive based on so-called metal "soaps", that is metal salts of acidic organic compounds, sometimes referred to as surfactants. Detergents that may be used in fuels include oil-soluble neutral and overbased salicylates, and sulfonates of a metal, particularly the alkali or alkaline earth metals, e.g., sodium, potassium, lithium, calcium, and magnesium, any of which may be present in detergents used in the marine fuel or heating oil composition according to any aspect of the present invention with or without other alkali or alkaline earth metals. For the present invention the metal detergent comprises calcium and/or strontium. Without wishing to be bound by theory, it is believed that calcium and strontium may be synergistic with the metal present in additive component (A) on account of electronic effects, with reference to atoms in an unexcited state, calcium and strontium being similar with one another in that the lowest unoccupied electron orbital in is a d-orbital. The corresponding lowest unoccupied orbital in beryllium and magnesium is a p-orbital, and for barium and radium the corresponding lowest unoccupied orbital is an f-orbital. In the particular case of calcium and iron, the highest unoccupied orbital for calcium is the same as the highest occupied orbital in iron. The alkaline earth metal detergent (B) may comprise calcium (or alternatively stated, the alkaline earth metal may be calcium).

Combinations of detergents, whether overbased or neutral or both, may be used. They generally comprise a polar head with a long hydrophobic tail. Overbased metal detergents, which typically comprise a basic core (e.g., metal carbonate) stabilized by a surfactant shell, frequently forming micelles, may be provided by including large amounts of metal base by reacting an excess of a metal base, such as an oxide or hydroxide, with an acidic gas such as carbon dioxide. The extent to which the metal base has reacted with the acidic gas is described as the degree of carbonation, determined as a percentage: the mass of reacted excess metal base divided by the sum of the mass of reacted excess metal base and the mass of unreacted excess metal base. In the case of calcium hydroxide, for example, the mass (or mol) of calcium present as $Ca(OH)_2$ divided by the sum of the mass (or mol) of calcium as $Ca(OH)_2$ and the mass (or mol) of calcium as CaCO3. The metal detergent may accordingly have a degree of carbonation from 50% to 95%, typically from 60% to 90%, also typically from 65% to 90% or from 65% to 85% and further typically from 70% to 80%. The metal detergent may have a degree of carbonation of 85% or greater, such as at least 86%, at least 87%, at least 90%, at least 91%, or at least 92%. The degree of carbonation is typically at most 100%, and may be at most 99%. The following general formula may be used to determine degree of carbonation (DOC):

$$DOC(\text{mole }\%) = \frac{(\text{Metalas Carbonate})}{[(\text{Metalas Carbonate}) + (\text{Metalas Strong Base})]} \times 10^2$$

The metal detergent may be a colloidal dispersion of detergent particles in the present invention, in which case the catalytic metal particles form a first colloidal dispersion and the metal detergent particles form a second colloidal dispersion. Within the colloidal dispersion, the metal detergent particles typically have a particle size of at least 1 nm, such as in a range with a lower end independently selected from 1 nm, 1.25 nm, 1.5 nm, 1.75 nm, 2 nm, 2.25 nm, 2.5 nm, 2.75 nm, 3 nm, 3.25 nm, 3.5 nm, 3.6 nm, 3.7 nm, 3.75 nm, 3.8 nm, 3.9 nm, 4 nm, 4.lnm, 4.2 nm, 4.25 nm, 4.3 nm, 4.4 nm, 4.5 nm, 4.6 nm, 4.7 nm, 4.75 nm, 4.8 nm, 4.85 nm, 4.9 nm, 4.95 nm or 5 nm and with an upper end independently selected from 1 μm, 950 nm, 900 nm, 850 nm, 800 nm, 750 nm, 700 nm, 650 nm, 600 nm, 550 nm, 500 nm, 450 nm, 400 nm, 350 nm, 300 nm, 250 nm, 200 nm, 175 nm, 150 nm, 125 nm, 100 nm, 90 nm, 80 nm, 70 nm, 60 nm, 50 nm, 45 nm, 40 nm, 35 nm, 30 nm, 28 nm, 25 nm, 22 nm, 20 nm, 19 nm, 18 nm, 17 nm, 16 nm, or 15 nm. The particle size may be from 1 nm to 1 μm, from 2 nm to 500 nm, from 3 nm to 100 nm, from 3 nm to 50 nm or from 5 nm to 15 nm.

In the present invention, metal detergents (B) may be metal hydrocarbyl-substituted hydroxybenzoate, more preferably hydrocarbyl-substituted salicylate, detergents. The metal may include an alkali metal (e.g., Li, Na, K) and/or an alkaline earth metal (e.g., Mg, Ca) but comprises calcium and/or strontium and preferably comprises calcium. In some embodiments, the metal content of the detergent, that may be measured as alkali metal and/or alkaline earth metal content, or the specific metal content (e.g., lithium content, sodium content, potassium content, magnesium content, calcium content and/or strontium content) of the detergent, may be from 1, 2, 3, 4, 5, 6, 7, 8, 9, 10, 11, 12, 13, or 14 wt % to 2, 3, 4, 5, 6, 7, 8, 9, 10, 11, 12, 13, 14, or 15 wt %, such as from 2 wt % to 15 wt %, from 5 wt % to 12 wt %, from 6 wt % to 10 wt % or from 7 wt % to 9 wt %. The metal, strontium and/or calcium content of the detergent may be about 8 wt %. In some examples, the calcium content of the metal detergent (B) is from 1, 2, 3, 4, 5, 6, 7, 8, 9, 10, 11, 12, 13, or 14% to 2, 3, 4, 5, 6, 7, 8, 9, 10, 11, 12, 13, 14, or 15 wt %, such as from 2 wt % to 15 wt %, from 5 wt % to 12 wt %, from 6 wt % to 10 wt %, or from 7 wt % to 9 wt %, or about 8 wt %.

As examples of hydrocarbyl, there may be mentioned alkyl and alkenyl. A preferred metal hydrocarbyl-substituted hydroxybenzoate is a calcium alkyl-substituted salicylate and has the structure shown:

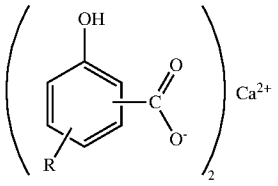

wherein R is a linear alkyl group. There may be more than one R group attached to the benzene ring. The $COO^-$ group can be in the ortho, meta or para position with respect to the hydroxyl group; the ortho position is preferred. The R group can be in the ortho, meta, or para position with respect to the hydroxyl group.

Salicylic acids are typically prepared by the carboxylation, by the Kolbe-Schmitt process, of phenoxides, and in that case will generally be obtained (normally in a diluent) in admixture with uncarboxylated phenol. Salicylic acids may be non-sulfurized or sulfurized, and may be chemically modified and/or contain additional substituents. Processes for sulfurizing an alkyl salicylic acid are well known to those skilled in the art, and are described in, for example, US 2007/0027057.

The alkyl groups, such as R in the structure above, may contain 8 to 100, advantageously 8 to 24, such as 14 to 20 or 14 to 18, carbon atoms.

The sulfonates of the invention may be prepared from sulfonic acids, which are typically obtained by the sulfonation of alkyl-substituted aromatic hydrocarbons such as those obtained from the fractionation of petroleum or by the alkylation of aromatic hydrocarbons. Examples include those obtained by alkylating benzene, toluene, xylene, naphthalene, diphenyl or their halogen derivatives such as chlorobenzene, chlorotoluene, and chloronaphthalene. The alkylation may be carried out in the presence of a catalyst with alkylating agents having from 3 to more than 70 carbon atoms. The alkaryl sulfonates usually contain from 9 to 80 or more carbon atoms, preferably from 16 to 60 carbon atoms per alkyl substituted aromatic moiety. The oil-soluble sulfonates or alkaryl sulfonic acids may be neutralized with oxides, hydroxides, alkoxides, carbonates, carboxylate, sulphides, hydrosulfides, nitrates, borates and ethers of the metal. The amount of metal compound is chosen having regard to the desired TBN of the final product, but typically ranges from 100 to 220 mass % (preferably at least 125 mass %) of that stoichiometrically required.

The term "overbased" is generally used to describe metal detergents in which the ratio of the number of equivalents of the metal moiety to the number of equivalents of the acid moiety is greater than one. The term low-based' is used to describe metal detergents in which the equivalent ratio of metal moiety to acid moiety is greater than 1, and up to about 2.

By an "overbased calcium salt of surfactants" is meant an overbased detergent in which the metal cations of the oil-insoluble metal salt are essentially calcium cations. Small amounts of other cations may be present in the oil-insoluble metal salt, but typically at least 80, more typically at least 90, for example at least 95, mole % of the cations in the oil-insoluble metal salt, are calcium ions. Cations other than calcium may be derived, for example, from the use in the manufacture of the overbased detergent of a surfactant salt in which the cation is a metal other than calcium. Preferably, the metal salt of the surfactant is also calcium.

Carbonated overbased metal detergents typically comprise amorphous nanoparticles. Additionally, the art discloses nanoparticulate materials comprising carbonate in the crystalline calcite and vaterite forms.

The basicity of the detergents may be expressed as a total base number (TBN), sometimes referred to as base number (BN). A total base number is the amount of acid needed to neutralize all of the basicity of the overbased material. The TBN may be measured using ASTM standard D2896 or an equivalent procedure. The detergent may have a low TBN (i.e., a TBN of less than 50), a medium TBN (i.e., a TBN of 50 to 150) or a high TBN (i.e., a TBN of greater than 150, such as 150-500). The basicity may also be expressed as basicity index (BI), which is the molar ratio of total base to total soap in the overbased detergent and may, in the context of the present invention, be in a range from 0.1, 0.5, 1, 1.5, 2, 2.5, 3, 3.5, 4, 4.5, 5, 5.5, 6, 6.5, 7, 7.5, 8, 8.5, 9 or 9.5 to 0.5, 1, 1.5, 2, 2.5, 3, 3.5, 4, 4.5, 5, 5.5, 6, 6.5, 7, 7.5, 8, 8.5, 9, 9.5 or 10, such as from 0.1 to 10, from 0.5 to 9, from 1 to 8.5, from 1.5 to 7, from 2 to 5 or from 2.5 to 3.5. The basicity index of the detergent may be about 3.

Additive Combination

The marine fuel oil of the invention comprises an additive combination which may consist of (or consist essentially of) additives (A) and (B). Accordingly, while treat rates of the additive combination referred to herein contemplate the treat rate to the marine fuel oil of the active ingredients (A) and (B) therein, it is to be understood that the additive combination may be introduced to a marine fuel oil in combination with, or simultaneously to, solvents, diluents or other additives such as detergents, dispersants, stabilizers, demulsifiers, emulsion preventatives, corrosion inhibitors, cold flow improvers such as pour point depressants and CFPP modifiers, viscosity modifiers, lubricity improvers or combustion improvers. Further, additives such as those listed above, may be additionally or alternatively added or blended with the marine fuel oil separately to the additive combination referred to in the invention, for example, simultaneously, before or after the additive combination of (A) and (B).

The combination of (A) and (B) may in principle be used in any ratio suitable for the desired application. By way of non-limiting examples, the ratio may be a mass ratio, based upon the mass of catalytic metal (such as, among the others listed above, iron and cerium) to alkaline earth metal (calcium and strontium) and may be in a range of from 1000:1 to 1:1000, from 100:1 to 1:100, from 10:1 to 1:10, from 5:1 to 1:5, from 3:1 to 1:3, from 2:1 to 1:2, or from 1:1 to 1:2 (or from less than 1:1 to 1:2), such as from 1:1.1 to 1:2, from 1:1.4 to 1:1.6 or about 1:1.5. The ratio may alternatively be a molar ratio of catalytic metal (such as, among the others listed above, iron and cerium) to alkaline earth metal (calcium and strontium) and may be in a range of from 1000:1 to 1:1000, from 100:1 to 1:100, from 10:1 to 1:15, from 5:1 to 1:10, from 3:1 to 1:5, from 2:1 to 1:4, from 1:1 to 1:3 (or from less than 1:1 to 1:3), from 1:1.5 to 1:2.5 or from 1:1.8 to 1:2.2 or about 1:2.

Carrier Fluid

Additive compositions according to the present invention typically further include a carrier fluid miscible with marine fuel oil. Examples of suitable such carrier fluids include heating oil, marine fuel oil (further detail of each is provided in the section below), mineral oils and hydrocarbonaceous solvents. Suitable hydrocarbonaceous solvents for the colloid include aromatic solvents such as the commercial mixed aromatic solvents Solves so and Shellsol, and aliphatic solvents such as isoalkanes, including Isopar L. Other suitable solvents known in the additives art may be used, such as Norpar (pentanes), Exxsol (dearomatized hydrocarbon fluids), Nappar (naphthenics), Varsol (non-dearomatized hydrocarbon fluids), xylenes, and HAN 8080 (aromatic solvent).

Marine Fuel Oils

The additives of the present invention have an application in a marine fuel or a heating oil. Accordingly, the present invention contemplates marine fuels and heating oils comprising an additive according to the first aspect of the invention.

The marine fuel oils of the invention may be defined according to the marine fuel specification for petroleum products of ISO 8217:2017, ISO 8217:2012, ISO 8217:2010 and/or ISO 8217:2005. It will be understood that other ISO 8217 editions, regional specifications and/or supplier/operator specifications may additionally, or alternatively, be met by the marine fuels according to the present invention.

In some embodiments, the oils may have a reduced sulfur content, such as a sulfur content of no greater than 0.5, for example less than 0.5, no greater than 0.4, less than 0.4, no greater than 0.3, less than 0.3, no greater than 0.2, less than 0.2, no greater than 0.1 or less than 0.1, mass % of atoms of sulfur. In some preferred embodiments, the sulfur content of the marine fuel oil may be less than 0.5 or even less than 0.1 mass % of atoms of sulfur. In other embodiments, the sulfur content of the oils may be up to, or under: 5 mass % of atoms of sulfur, 4 mass % of atoms of sulfur, 3 mass % of atoms of sulfur, 2 mass % of atoms of sulfur, 1.5 mass % of atoms of sulfur, 1 mass % of atoms of sulfur, 0.75 mass % of atoms of sulfur, or 0.5 mass % of atoms of sulfur.

For example, all or part of the marine fuel oil or heating oil of the invention may be produced from crude oil by means of fractional distillation.

In the marine fuel oil or heating oil of the invention additives (A) and (B) may be used as or with one or more of detergents, dispersants, stabilizers, demulsifiers, emulsion preventatives, corrosion inhibitors, cold flow improvers, such as pour point depressants and CFPP modifiers, viscosity modifiers, lubricity improvers or combustion improvers. Alternatively stated, the additive combination consisting of (A) and (B) may be used together with one or more further additives such as detergents, dispersants, stabilizers, demulsifiers, emulsion preventatives, corrosion inhibitors, cold flow improvers, such as pour point depressants and CFPP modifiers, viscosity modifiers, lubricity improvers, or combustion improvers.

In (B), the (or each) detergent may have a TBN in a range with a lower limit of 0, 50, 100, or 150 and an upper limit of 300, 350, 400, 450, or 500.

The combination of (A) and (B) may, in principle, be used in marine fuels or heating oils in any ratio suitable for the desired application. By way of non-limiting examples, the ratio may be a mass ratio, based upon the mass of catalytic metal (such as, among the others listed above, iron and cerium) to alkaline earth metal (calcium and strontium) and may be in a range of from 1000:1 to 1:1000, from 100:1 to 1:100, from 10:1 to 1:10, from 5:1 to 1:5, from 3:1 to 1:3, from 2:1 to 1:2, or from 1:1 to 1:2 (or from less than 1:1 to 1:2), such as from 1:1.1 to 1:2, from 1:1.4 to 1:1.6 or about 1:1.5. The ratio may alternatively be a molar ratio of catalytic metal (such as, among the others listed above, iron and cerium) to alkaline earth metal (calcium and strontium) and may be in a range of from 1000:1 to 1:1000, from 100:1 to 1:100, from 10:1 to 1:15, from 5:1 to 1:10, from 3:1 to 1:5, from 2:1 to 1:4, from 1:1 to 1:3 (or from less than 1:1 to 1:3), from 1:1.5 to 1:2.5, or from 1:1.8 to 1:2.2, or about 1:2. The amounts cited may be inclusive or exclusive of any metal present in the fuel prior to including the additive (such as any metal in the base fuel) and/or any metal added to the fuel through another source.

The treat rate of the additive composition of the present invention into a marine fuel, marine fuel oil or heating oil may be, by weight of metal, from 1 ppm to 1000 ppm, such as 5 ppm to 500 ppm, 10 ppm to 100 ppm, 25 ppm to 70 ppm, or 40 ppm to 60ppm.

Where iron is present, the treat rate of the additive composition of the present invention (or the colloidal dispersion of catalytic metal particles) into a marine fuel, marine fuel oil or heating oil, by weight of iron, may be from 1 ppm to 1000 ppm, such as 2 ppm to 500 ppm, 5 ppm to 200 ppm, 10 ppm to 100 ppm, 12 ppm to 50 ppm, or 15 ppm to 30 ppm.

Where calcium is present, the treat rate of the additive composition of the present invention (or the alkaline earth metal detergent) into a marine fuel, marine fuel oil, or heating oil, by weight of calcium, may be from 1 ppm to 1000 ppm, such as 2 ppm to 500 ppm, 5 ppm to 200 ppm, 10 ppm to 100 ppm, 15 ppm to 60 ppm, or 20 ppm to 40 ppm.

Methods and Uses

The present invention also contemplates methods of improving the fuel economy, combustion characteristics, and/or emissions performance of a marine fuel and/or heating oil comprising the step of combining the marine fuel and/or heating oil with an additive composition according to the first aspect of the invention.

The present invention also contemplates methods of producing a marine fuel and/or heating oil comprising the step of combining a marine fuel oil, a heavy fuel oil, a marine distillate fuel and/or a residual fuel oil with an additive composition according to the first aspect of the invention.

Furthermore, the present invention contemplates uses of an additive composition according to the first aspect of the invention to improve the fuel economy, combustion characteristics, and/or emissions performance of a marine fuel and/or a heating oil, or to additize a marine fuel and/or a heating oil. The additive compositions according to the first aspect of the invention may be used to treat diesel or other hydrocarbonaceous fuels.

For example, the additives of the present invention may reduce fuel consumption of an engine burning marine fuel (including heavy fuel oil and very low sulfur fuel oil) and/or heating oil by an amount more than 0.2%, or in a range of from 0.2%, more than 0.2%, 0.3%, more than 0.3%, 0.4%, more than 0.4%, 0.5%, more than 0.5%, 0.6%, more than 0.6%, 0.7%, more than 0.7%, 0.8%, more than 0.8%, 0.9%, more than 0.9%, 1% or more than 1%, to 5%, less than 5%, 4%, less than 4%, 3%, less than 3%, 2%, less than 2%, 1.5%, less than 1.5%, 1.4%, less than 1.4%, 1.3%, less than 1.3%, 1.2%, less than 1.2%, 1.1% or less than 1.1%, such as from 0.2% to 2%, more than 0.3% to 1.5%, 0.5% to 1.5%, or 0.8% to 1.4%.

By way of further example, the additives of the present invention may reduce total hydrocarbon emissions of an engine burning marine fuel (including heavy fuel oil and very low sulfur fuel oil) and/or heating oil by an amount more than 3.6% or in a range of from more than 3.6%, 3.7%, more than 3.7%, 4%, more than 4%, 5%, more than 5%, 6%, more than 6%, 7%, more than 7%, 8% or more than 8%, to 20%, less than 20%, 17%, less than 17%, 15%, less than 15%, 14%, less than 14%, 13%, less than 13%, 12%, less than 12%, 11%, less than 11%, 10%, less than 10%, 9% or less than 9%, such as from more than 3.6% to 20%, 3.7% to 18%, 5% to 15%, 7% to 12% or 8% to 10%.

By way of further example, the additives of the present invention may reduce nitrogen monoxide emissions of an engine burning marine fuel (including heavy fuel oil and very low sulfur fuel oil) and/or heating oil by an amount more than 1.7% or in a range of from more than 1.7%, 2%, more than 2%, 3%, more than 3%, 4%, more than 4%, 5%, more than 5%, 6%, more than 6%, 6.5% or more than 6.5%, to 20%, less than 20%, 17%, less than 17%, 15%, less than 15%, 14%, less than 14%, 13%, less than 13%, 12%, less than 12%, 11%, less than 11%, 10%, less than 10%, 9%, less than 9%, 8%, less than 8%, 7%, or less than 7% such as from more than 1.7% to 20%, 2% to 15%, 4% to 12%, 5% to 10%, or 6% to 8%.

By way of further example, the additives of the present invention may reduce carbon monoxide emissions of an engine burning marine fuel (including heavy fuel oil and very low sulfur fuel oil) and/or heating oil by an amount more than 0.4% or in a range of from more than 0.4%, 0.5%, more than 0.5%, 1%, more than 1%, 1.5%, more than 1.5%, 2%, more than 2%, 2.5%, more than 2.5%, 3%, more than 3%, 3.5%, more than 3.5%, 4%, more than 4%, 4.5%, more than 4.5%, 5%, more than 5%, 5.5%, more than 5.5%, 6%, more than 6% to 20%, less than 20%, 17%, less than 17%, 15%, less than 15%, 14%, less than 14%, 13%, less than 13%, 12%, less than 12%, 11%, less than 11%, 10%, less than 10%, 9%, less than 9%, 8%, less than 8%, 7%, less than 7%, 6%, less than 6%, 5%, less than 5%, 4%, less than 4%, 3.5% or less than 3.5%, such as from more than 0.4% to 20%, 2% to 15%, 2.5% to 10%, or 3% to 9%, and such as from 1% to 4% (notably for a heavy fuel oil) or from 6% to 9% (notably for a very low sulfur fuel oil).

By way of further example, the additives of the present invention may reduce carbon dioxide emissions of an engine burning marine fuel (including heavy fuel oil and very low sulfur fuel oil) and/or heating oil by an amount of more than 0% or in a range of from more than 0%, 0.1%, more than 0.1%, 0.2%, more than 0.2%, 0.3%, more than 0.3%, 0.4%, more than 0.4%, 0.5%, more than 0.5%, 0.6%, more than 0.6%, 0.7%, more than 0.7%, 0.8%, more than 0.8%, 0.9%, more than 0.9%, 1% or more than 1%, to 5%, less than 5%, 4%, less than 4%, 3%, less than 3%, 2%, less than 2%, 1.8%, less than 1.8%, 1.6%, less than 1.6%, 1.4%, or less than 1.4%, such as from more than 0% to 5%, 0.5% to 3%, 0.7% to 1.5%, or 0.9% to 1.4%, and such as from 0.4% to 1.5% or from 1 to 1.3% (notably for a heavy fuel oil) and from 0.1% to 1.5% or from 0.8% to 1.4% (notably for a very low sulfur fuel oil).

By way of further example, the additives of the present invention may reduce fuel smoke number emissions (SFOC ISO 3046-1) of an engine burning marine fuel (including heavy fuel oil and very low sulfur fuel oil) and/or heating oil by an amount of more than 3.6% or in a range of from more than 3.6%, 4%, more than 4%, 5%, more than 5%, 6%, more than 6%, 7%, more than 7%, 8%, more than 8%, 9%, more than 9%, 10%, more than 10%, 11%, more than 11%, 12%, more than 12%, 13%, more than 13%, 14%, more than 14%, 15%, more than 15%, 16%, more than 16%, 17% or more than 17%, to 50%, less than 50%, 40%, less than 40%, 30%, less than 30%, 25%, less than 25%, 22%, less than 22%, 20%, less than 20%, 19%, less than 19%, 18% or less than 18%, such as from more than 3.6% to 50%, 4% to 20%, 10% to 20%, 11% to 20%, 13% to 20%, 11% to 18% or 13% to 18%, and such as from 4% to 15% or from 4 to 12% (notably for a heavy fuel oil) and from 13% to 20% or from 13% to 18% (notably for a very low sulfur fuel oil).

Selected Embodiments

Some embodiments of the invention include:

1. An additive composition for a marine fuel or a heating oil comprising:

a. a colloidal dispersion of catalytic metal particles, the particles comprising:

i. a metal compound core, the metal compound comprising at least one of iron, ruthenium, osmium, cerium, nickel, palladium, and platinum; and ii. a polyalkenyl-substituted carboxylic acid or anhydride, or a derivative thereof;

b. a neutral or overbased alkaline earth metal detergent comprising calcium and/or strontium; and c. a carrier fluid miscible with a marine fuel oil, a heavy fuel oil, a marine distillate fuel, and/or a residual fuel oil.

2. An additive composition according to embodiment 1, wherein the metal compound is a compound of iron, a compound of cerium or mixtures thereof, alternatively wherein the metal compound is iron oxide, cerium oxide, or mixtures thereof and further alternatively iron (III) oxide and/or iron (II,III) oxide.

3. An additive composition according to embodiment 1, wherein the catalytic metal particles have a particle size of from 1 nm to 1 μm, from 2 nm to 500 nm, from 3 nm to 100 nm, from 3 nm to 50 nm or from 5 nm to 15 nm.

4. An additive composition according to embodiment 1, wherein the overbased alkaline earth metal detergent forms a second colloidal dispersion in the additive composition having a particle size of from 1 nm to 1 μm, from 2 nm to 500 nm, from 3 nm to 100 nm, from 3 nm to 50 nm or from 5 nm to 15 nm.

5. An additive composition according to embodiment 1, wherein the polyalkenyl-substituted carboxylic acid or anhydride, or derivative thereof, is or is derived from a di-, tri-, or polycarboxylic acid, alternatively wherein the polyalkenyl-substituted carboxylic acid or anhydride, or derivative thereof, is or is derived from a di- or tri-carboxylic acid, further alternatively wherein the polyalkenyl-substituted carboxylic acid or anhydride, or derivative thereof, is or is derived from a di-carboxylic acid.

6. An additive composition according to embodiment 5, wherein each carboxylic acid group or its derivative is separated from another carboxylic acid group by no more than three or by no more than two carbon atoms within the polyalkenyl-substituted carboxylic acid.

7. An additive composition according to embodiment 1, wherein the polyalkenyl moiety has a number average molecular weight of from 100 to 4000, from 200 to 2250, from 250 to 2000, from 500 to 1500, from 750 to 1250, or from 850 to 1100.

8. An additive composition according to embodiment 1, wherein the polyalkenyl-substituted carboxylic acid or anhydride, or a derivative thereof, is poly(isobutenyl) succinic acid or a derivative thereof.

9. An additive composition according to embodiment 1, wherein the polyalkenyl-substituted carboxylic acid or anhydride, or a derivative thereof is a fatty acid, optionally wherein the fatty acid is monounsaturated or saturated, further, optionally wherein the fatty acid is selected from capric acid, lauric acid, myristic acid, palmitic acid, stearic acid, arachidic acid, behenic acid, lignoceric acid, caproleic acid, lauroleic acid, myristoleic acid, palmitoleic acid, oleic acid, elaidic acid, vaccenic acid, gadoleic acid, erucic acid, brassidic acid, nervonic acid, and again further, optionally wherein the fatty acid is oleic acid.

10. An additive composition according to embodiment 1 wherein the alkaline earth metal detergent:

a. is overbased;

b. comprises calcium; and/or c. comprises hydroxybenzoate, salicylate, or sulphonate.

11. An additive composition according to embodiment 1, wherein the alkaline earth metal detergent comprises calcium salicylate, alternatively wherein the alkaline earth metal detergent is an overbased calcium salicylate detergent, and also alternatively wherein the alkaline earth metal detergent is calcium salicylate overbased with calcium hydroxide/calcium carbonate.

12. An additive composition according to embodiment 1, wherein the alkaline earth metal detergent has a degree of carbonation of from 50% to 95%, typically from 60% to 90%, also typically from 65% to 90% or from 65% to 85%, and further typically from 70% to 80%.

13. An additive composition according to embodiment 1, wherein the alkaline earth metal detergent has a basicity index of from 0.1 to 10, from 0.5 to 9, from 1 to 8.5, from 1.5 to 7, from 2 to 5, from 2.5 to 3.5, or of about 3.

14. An additive composition according to embodiment 1, wherein the ratio of the colloidal dispersion of catalytic metal particles by mass of catalytic metal to neutral or overbased alkaline earth metal detergent by mass of alkaline earth metal, is in the range of from 1000:1 to 1:1000, from 100:1 to 1:100, from 10:1 to 1:10, from 5:1 to 1:5, from 3:1 to 1:3, from 2:1 to 1:2, from 1:1 to 1:2, from less than 1:1 to 1:2, from 1:1.1 to 1:2, from 1:1.4 to 1:1.6 or is about 1:1.5, or wherein the molar ratio of catalytic metal to alkaline earth metal is in a range of from 1000:1 to 1:1000, from 100:1 to 1:100, from 10:1 to 1:15, from 5:1 to 1:10, from 3:1 to 1:5, from 2:1 to 1:4, from 1:1 to 1:3, from less than 1:1 to 1:3, from 1:1.5 to 1:2.5, from 1:1.8 to 1:2.2, or is about 1:2.

15. A marine fuel composition or heating oil composition comprising an additive composition according to embodiment 1 and a marine fuel oil, a heavy fuel oil, a marine distillate fuel and/or a residual fuel oil.

16. The marine fuel composition or heating oil composition of embodiment 15, wherein the marine fuel composition, the marine fuel oil, the heavy fuel oil, the marine distillate fuel and/or the residual fuel oil:

i. is defined according to, or meets, at least one of the marine fuel specifications for petroleum products of ISO 8217: 2017, ISO 8217:2012, ISO 8217:2010 and/or ISO 8217: 2005;

ii. has a sulfur content of no greater than 5 mass %, 2 mass %, 1 mass %, 0.5, mass % or 0.1 mass % of atoms of sulfur;

iii. is at least in part, or optionally in the case of the marine fuel oil entirely, produced from crude oil by means of fractional distillation;

iv. contains one or more further additives, optionally selected from detergents, dispersants, stabilizers, demulsifiers, emulsion preventatives, corrosion inhibitors, cold flow improvers, pour point depressants and CFPP modifiers, viscosity improvers, lubricity improvers, and/or combustion improvers; or v. any combination of i. to iv.

17. A marine fuel composition or heating oil composition according to embodiment 15 comprising the additive composition in an amount of:

a. from 1 ppm to 1000 ppm, such as 5 ppm to 500 ppm, 10 ppm to 100 ppm, 25 ppm to 70 ppm, or 40 ppm to 60ppm by mass of metal;

b. from 1 ppm to 1000 ppm, such as 2 ppm to 500 ppm, 5 ppm to 200 ppm, 10 ppm to 100 ppm, 12 ppm to 50 ppm, or 15 ppm to 30 ppm by mass of catalytic metal, optionally or alternatively by mass of iron; or c. from 1 ppm to 1000 ppm, such as 2 ppm to 500 ppm, 5 ppm to 200 ppm, 10 ppm to 100 ppm, 15 ppm to 60 ppm, or 20 ppm to 40 ppm by mass of alkaline earth metal, optionally, or alternatively, by mass of calcium.

18. A method of improving the fuel economy, combustion characteristics and/or emissions performance of a marine fuel or heating oil comprising the step of combining the marine fuel or heating oil with an additive composition according to embodiment 1.

19. A method of producing a marine fuel or heating oil comprising the step of combining a marine fuel oil, a heavy fuel oil, a marine distillate fuel and/or a residual fuel oil with an additive composition according to embodiment 1.

20. Use of an additive composition according to embodiment 1 to improve the fuel economy, combustion characteristics and/or emissions performance of a marine fuel or heating oil.

21. Use of a two-way additive combination in an effective minor amount, in a marine fuel or heating oil to improve the fuel economy, combustion characteristics and/or emissions perfomance of said marine fuel or said heating oil, the two-way additive combination comprising (A) a colloidal dispersion of catalytic metal particles, the particles comprising: (i) a metal compound core, the metal compound comprising at least one of iron, ruthenium, osmium, cerium, nickel, palladium, and platinum, as deined and identifed herein; and (ii) a polyalkenyl-substituted carboxylic acid or anhydride, or a derivative thereof, as defined and identified herein; and, (B) a neutral or overbased alkaline earth metal detergent comprising calcium and/or strontium, as defined and identified herein.

EXAMPLES

The following non-restrictive examples illustrate the invention.

Marine Engine Information

A Caterpillar MaK 6M20, 6 cylinder, 4 stroke test engine with pump line nozzle injection was used for the examples that follow. The engine had the specification provided in Table 1 below:

TABLE 1

Test Engine Specifications

| Parameter | Details |
|---|---|
| Charge air compression | Single stage turbo charger |
| Rated speed | 1000 rpm |
| Rated power | 1020 kW |
| Bore/stroke | 200 mm/300 mm |
| Engine displacement | 56.4 L |
| Compression ratio | 14.8 |
| Maximum injection pressure | >1500 bar |

Fuel Information

Two different fuels were assessed using the test engine to determine additive impact on a heavy fuel oil (HFO, 1.2% sulfur fuel) and a very low sulfur fuel oil (VLSFO, 0.5% S fuel). The fuels had the characteristics tabulated in Table 2 below:

TABLE 2

Test Fuel Characteristics

| Characteristic | HFO Fuel 1 | VLSFO Fuel 2 |
|---|---|---|
| S (%) | 1.2 | 0.44 |
| CCAI (calculated carbon aromaticity index) | 873 | 812 |
| ECN (estimated cetane number) | 22.6 | 38.4 |
| Density @ 15° C. (kg/m$^3$) | 991.8 | 948.5 |
| Viscosity @ 50° C. (mm$^2$/s) | 72.2 | 294.0 |
| TSP (total sediment potential) (%) | 0.05 | 0.01 |
| Pour point (° C.) | −12 | 27 |

Operating Routine

For each experiment, the operating routine in Table 3 below was adopted:

TABLE 3

Operating Routine

| Operation | Time (approx. hours) |
|---|---|
| Engine warm up (MGO fuel) | 0.5 |
| Switch fuel from MGO to VLSFO or HFO | 1 |
| Base fuel measurements | 1 |
| Commence additive dosing and flush fuel line | 1 |
| Additized fuel measurements | 1 |
| Stop additive dosing and flush fuel line | 1 |
| Base fuel measurements | 1 |
| Switch fuel from VLSFO or HFO to MGO | 1 |
| Engine cool down | 0.5 |

During the experiments, measurements were made of the carbon monoxide, carbon dioxide, nitrogen monoxide, and total hydrocarbons in the exhaust gas using an ABB Advanced Optima 2000 exhaust gas measurement system, filter smoke number using an AVL Smokemeter 415S and fuel consumption using a Krohne OPTIMASS 6400F coriolis flow meter.

Fuel Dosing

The additive was injected directly into the fuel line when required during the test day. This was achieved using a simple HPLC pump set up incorporated into the engine's fuel system. The fuel system can be seen in the schematic of FIG. 1 (HFO is used here, however VLSFO can also be used). The additive was dosed in such a way that enabled directly comparable measurements to be made with the dosing activated (additive present) or not (additive absent); the additive was not introduced into the bunker tank although introducing the additive there or into the fuel before bunkering (for example, at a refinery or terminal) is within contemplation.

Examples in HFO Fuel 1:

The operating routine and engine were set up as described above. A 6-cylinder, 4-stroke test engine was utilized to assess the additives impact on fuel consumption and emissions of a typical high sulfur heavy fuel oil. The additives were introduced into the fuel system to allow for dosing when required and prevent contamination of the bulk fuel tank.

The following additives were tested:

Additive A: Calcium salicylate detergent overbased with $CaCO_3$ (degree of carbonation approximately 75%) (delivered at 25 ppm Ca treat rate in fuel);

Additive B: Colloidal dispersion of Iron (II,III) oxide particles stabilized with poly(isobutene) succinic acid (PIB number average molecular weight 1000) (delivered at 20 ppm Fe treat rate in fuel); and Additive C: Ferrocene (delivered at 25 ppm Fe treat rate in fuel) in combination with calcium salicylate detergent overbased with $CaCO_3$ (degree of carbonation approximately 75%) (delivered at 30 ppm Ca treat rate in fuel).

The treat rate of the additives could be easily adjusted using the dosing system set up and ICP measurements of fuel samples were used to confirm actual treat rates achieved.

Data was collected for approximately one hour for each test phase — first the base fuel, then additized fuel and then again the base fuel. This enables a statistical analysis of the data and prevents any natural drift in measurements throughout the day being incorrectly analyzed as additive effect.

The results of the additives' impact on fuel consumption and emissions are detailed in Table 4, below. As may be seen, Example 1 of the invention provided a significant reduction in emissions and fuel consumption (increase in fuel economy), in each case superior to the measurements for Examples 2-4.

TABLE 4

Emission and Fuel Economy Performance of Examples 1-4

| | Additive | | | |
|---|---|---|---|---|
| Measurement | Example 1: (Invention) Additive A combined with Additive B | Example 2: (Comparative) Additive A | Example 3: (Comparative) Additive B | Example 4: (Comparative) Additive C |
| | Change vs. Base Fuel | | | |
| Fuel consumption (SFOC ISO 3046-1) | −1.06% | 0.1% | 0% | −0.2% |
| Filter smoke number | −11.2% | −3.3% | −3.6% | 3.4% |
| NO (ppm) | −6.9% | −1.7% | 0.7% | — |
| Total hydro-carbons (ppm) | −8.9 | −3.6% | 1.8% | −0.8% |
| CO (ppm) | −3.1% | −0.4% | 4.8% | 0.1% |
| $CO_2$ (ppm) | −1.2% | 0% | −0.2% | −0.3% |

Examples in VLSFO Fuel 2

In the examples that follow, the operating routine and engine set up were as described above. VLSFO Fuel 2 as described above was used in the engine as base fuel.

Data was collected for approximately one hour for each test phase—first the base fuel, then additized fuel and then again the base fuel. This provides more robust results by mitigating any natural drift in measurements throughout the day as the engine runs being incorrectly analyzed as additive effect.

The following additives were tested:

Additive A: Calcium salicylate detergent overbased with $CaCO_3$ (degree of carbonation approximately 75%);

Additive B: Colloidal dispersion of Iron (II,III) oxide particles stabilized with poly(isobutene) succinic acid (PIB number average molecular weight 1000);

Additive C: Colloidal dispersion of Iron (II,III) oxide particles stabilized with stabilized with oleic acid;

Additive D: Ferrocene (delivered at 20 ppm Fe treat rate in fuel) in combination with Calcium salicylate detergent overbased with $CaCO_3$ (degree of carbonation approximately 75%); and Additive E: Magnesium salicylate detergent overbased with $MgCO_3$ (degree of carbonation approximately 70%).

The results of the additive impact on fuel consumption and emissions are detailed in Table 5, below. As may be seen, Examples 5 and 7 of the invention provided a significant reduction in emissions and fuel consumption (increase in fuel economy), in each case superior to the measurements for Examples 6, 8, and 9.

TABLE 5

Emission and Fuel Economy performance of Examples 5-9

| | Additive | | | | |
|---|---|---|---|---|---|
| Measurement | Example 5: (invention) Additives A & B (25 ppm Fe; 30 ppm Ca) | Example 6: (comparative) Additive A (90 ppm Ca) | Example 7: (invention) Additives A & C (30 ppm Fe; 45 ppm Ca) | Example 8: (comparative) Additives A & D (20 ppm Fe; 25 ppm Ca) | Example 9: (comparative) Additives B & E (25 ppm Fe; 30 ppm Mg) |
| | Impact vs. Base fuel | | | | |
| Fuel consumption (SFOC ISO 3046-1) | −1.3% | −0.25% | −0.9% | −0.3% | 0% |
| Filter smoke number | −14.5% | −14.6% | −17.5% | −12.7% | −2.3% |
| CO (g/kWh) | −8.8% | −8.9% | −6.2% | −4.1% | −3.1% |
| $CO_2$ (g/kWh) | −1.3% | 0.3% | −0.9% | 0.2% | 0.1% |

Thermo Gravimetric Analysis (TGA)

Thermo Gravimetric Analysis (TGA) is a standard technique which may be used to demonstrate the efficacy of a potential combustion improver in a fuel by measuring the weight loss from a fuel compoistion as a function of increasing temperature. For example, an increased weight loss from a fuel compoistion at a lower temperature is indicative of enhanced efficacy of a fuel additive as a combustion improver (for example, improved fuel combustion characteristics) and reduced soot deposition and/or reduced emmissions by the fuel compoistion.

The thermo gravimetric instrument used comprised a Q5000 analyser obtainable from TA Instruments, which included a thermobalance and a 25 pan autosampler. Samples of each composition were placed in the sample pans on each sample cradle around the auto-sampler platform. Sample testing was automated and software controlled, including pan taring and loading, sample weighing, auto-sampler movement, furnace heating and cooling. The recorded sample weight loss was due to high temperature combustion and volatilization of the sample. Samples were heated from 50° C. to 600° C. at a heating rate of 10° C. per minute. The test was performed in air.

The fuel compositions which were tested comprised:

VLSFO Fuel 2 (BF 1)—A comparative untreated baseline fuel oil;

Inventive Composition 1 (IC 1)—VLSFO Fuel 2 dosed with a two-way additive combination comprising (A) colloidal dispersion of Iron (II,III) oxide particles stabilized with poly(isobutene) succinic acid (PIB number average molecular weight 1000) added at 20 ppm Fe treat rate in fuel, and (B) calcium salicylate detergent overbased with $CaCO_3$ (degree of carbonation approximately 75%) added at 30 ppm calcium treat rate in fuel; and Inventive Composition 2 (IC 2)—VLSFO Fuel 2 dosed with a two-way additive combination comprising (A) colloidal dispersion of Cerium oxide particles stabilized with poly(isobutene) succinic acid (PIB number average molecular weight 1000) added at 20 ppm cerium treat rate in fuel, and (B) calcium salicylate detergent overbased with $CaCO_3$ (degree of carbonation approximately 75%) added at 30 ppm calcium treat rate in fuel.

Figure 2:
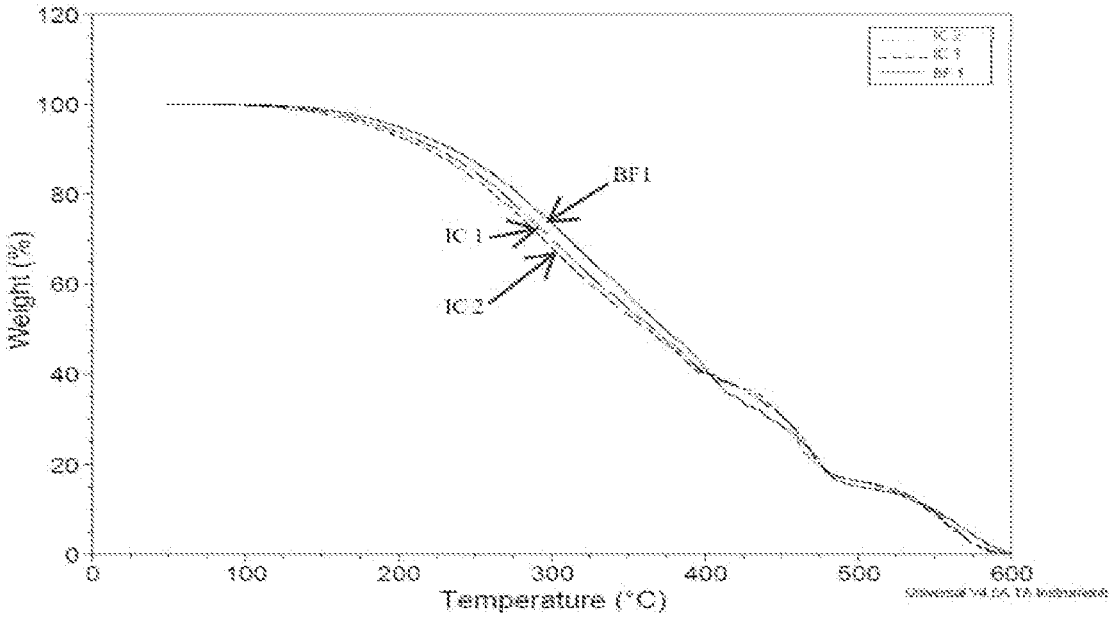
FIG. 2: There is shown in FIG. 2 Thermo Gravimetric Analysis (TGA) plot showing weight loss from a very low sulfur fuel oil (VLSFO, 0.5% S fuel) as a function of temperature increase. The compositions tested comprise: (Base Fuel 1) untreated VLSFO; (Inventive Composition 1) VLSFO including an additive composition of the invention where the metal (a)(i) comprises iron; and (Inventive Composition 2) VLSFO including an additive composition of the invention where the metal (a)(i) comprises cerium.

As is shown in FIG. 2, each fuel composition of Inventive Composition 1 (IC 1) comprising the VLSFO Fuel 2 and two-way additive combination where the metal is iron and Inventive Composition 2 (IC 2) comprising the VLSFO Fuel 2 and two-way additive combination where the metal is cerium exhibits increased weight loss at a specific temperature compared to the untreated VLSFO Fuel 2 alone (BF 1). The increased weight loss from each fuel composition of Inventive Composition 1 and Inventive Composition 2 is apparent across the temperature range of approximately 100° C. to 400° C. Accordingly, the TGA results demonstrate that each fuel composition of Inventive Composition 1 and Inventive Composition 2 exhibit improved combustion characteristics and/or reduced emmissions at a given temperature, and across a relatively broad temperature range, compared to the untreated VLSFO Fuel 2 alone.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope and spirit of this invention.

What is claimed is:

1. An additive composition for a marine fuel or a heating oil comprising:

a. a colloidal dispersion of catalytic metal particles, the particles comprising:

i. a metal compound core, the metal compound comprising iron (III) oxide and/or iron (II,III) oxide; and ii. a polyalkenyl-substituted carboxylic acid or anhydride, or a derivative thereof;

wherein the polyalkenyl moiety has a number average molecular weight of from 100 to 4000 g/mol, and wherein the polyalkenyl-substituted carboxylic acid or anhydride, or a derivative thereof, is oleic acid, poly(isobutenyl) succinic acid, or poly(isobutenyl) succinic anhydride, or a derivative thereof;

b. an overbased alkaline earth metal detergent comprising calcium salicylate;and c. a carrier fluid miscible with a marine fuel oil, a heavy fuel oil, a marine distillate fuel and/or a residual fuel oil.

2. The additive composition of claim 1, wherein the catalytic metal particles have a particle size of from 1 nm to 1 μm.

3. The additive composition of claim 2, wherein the catalytic metal particles have a particle size of from 3 nm to 50 nm.

4. The additive composition of claim 1, wherein the overbased alkaline earth metal detergent forms a second colloidal dispersion in the additive composition having a particle size of from 1 nm to 1 μm.

5. The additive composition of claim 4, wherein the second colloidal dispersion has a particle size of from 3 nm to 100 nm.

6. The additive composition of claim 1, wherein the polyalkenyl-substituted carboxylic acid or anhydride, or derivative thereof, is or is derived from a di-, tri-, or polycarboxylic acid.

7. The additive composition of claim 6, wherein each carboxylic acid group or its derivative is separated from another carboxylic acid group by no more than three carbon atoms within the polyalkenyl-substituted carboxylic acid.

8. The additive composition of claim 1, wherein the alkaline earth metal detergent has a degree of carbonation of from 50% to 95%, and/or has a basicity index of from 0.1 to 10.

9. The additive composition of claim 1, wherein the ratio of the colloidal dispersion of catalytic metal particles by mass of catalytic metal to overbased alkaline earth metal detergent by mass of alkaline earth metal is in the range of from 100:1 to 1:100, or wherein the molar ratio of catalytic metal to alkaline earth metal is in a range of from 100:1 to 1:100.

10. The additive composition of claim 9, wherein the ratio of the colloidal dispersion of catalytic metal particles by mass of catalytic metal to overbased alkaline earth metal detergent by mass of alkaline earth metal is in the range of from 3:1 to 1:3, or wherein the molar ratio of catalytic metal to alkaline earth metal is in a range of from 2:1 to 1:4.

11. A marine fuel and/or heating oil composition comprising the additive composition of claim 1 in addition to a marine fuel oil, a heavy fuel oil, a marine distillate fuel, and/or a residual fuel oil.

12. The marine fuel and/or heating oil composition of claim 10, wherein the marine fuel composition, the marine fuel oil, the heavy fuel oil, the marine distillate fuel, and/or the residual fuel oil:

i. is defined according to, or meets, at least one of the marine fuel specifications for petroleum products of ISO 8217:2017, ISO 8217:2012, ISO 8217:2010, and/or ISO 8217:2005;

ii. has a sulfur content of no greater than 2 mass% of atoms of sulfur;

iii. is at least in part, or in the case of the marine fuel oil entirely, produced from crude oil by means of fractional distillation;

iv. contains one or more further additives selected from detergents, dispersants, stabilizers, demulsifiers, emulsion preventatives, corrosion inhibitors, cold flow improvers, pour point depressants and CFPP modifiers, viscosity improvers, lubricity improvers, and/or combustion improvers; or v. any combination of i. to iv.

13. The marine fuel and/or heating oil composition of claim 11, comprising the additive composition in an amount so as to provide from 5 ppm to 200 ppm by mass of catalytic metal and from 5 ppm to 200 ppm by mass of calcium.

14. A method of improving the fuel economy, combustion characteristics, and/or emissions performance of a marine fuel or heating oil comprising the step of combining the marine fuel or heating oil with an effective amount of the additive composition of claim 1.

* * * * *